United States Patent [19]

Fallows et al.

[11] Patent Number: 5,000,577

[45] Date of Patent: Mar. 19, 1991

[54] LIGHT WEIGHT, HIGH EFFICIENCY VIBRATOR APPARATUS FOR FACILITATING BULK MATERIAL HANDLING AND TRANSPORT

[76] Inventors: John H. Fallows, 12025 Fairway Dr., Little Rock, Ark. 72212; Kenny D. Breeding, 15 Oak Forest Loop, Maumelle, Ark. 72118

[21] Appl. No.: 402,464

[22] Filed: Sep. 1, 1989

[51] Int. Cl.[5] ..... B01F 11/00

[52] U.S. Cl. ..... 366/126; 74/87

[58] Field of Search ..... 366/124, 125, 126, 108, 366/128; 74/87; 209/366.5; 164/203

[56] References Cited

U.S. PATENT DOCUMENTS

| | | | |
|---|---|---|---|
| 2,793,009 | 5/1957 | Peterson | 74/87 |
| 3,365,964 | 1/1968 | Matson | 74/87 |
| 3,463,458 | 8/1969 | Becker | 74/87 |

OTHER PUBLICATIONS

Bulk Equipment Systems Technology, Inc., Series BV Air Powered Ball Vibrators.

Dynapac, Top Dog Ball Vibrators.

Global Manufacturing, Inc., Industrial Vibrators (1978).

Industrial Technologies, Inc. Industrial Vibrators (1978).

Vibco Vibration Products.

*Primary Examiner*—Robert W. Jenkins

*Attorney, Agent, or Firm*—Hubbard, Thurman, Tucker & Harris

[57] ABSTRACT

The housing of a rotary ball type industrial vibrator is injection molded from a reinforced plastic material, and an annular metal raceway structure is molded integrally with the housing and forms a contact surface for a metal ball disposed within the interior of the housing. In response to a flow of pressurized air through the housing, the ball is rapidly rotated around the metal raceway to impart oscillating vibrational forces which are transmitted through the housing to a bulk material handling structure to which it is rigidly secured. The light weight plastic housing facilitates a highly efficient vibrational force transfer to the material handling structure, and the integrally molded metal raceway structure isolates the rotating ball from the interior plastic housing surface to prevent internal housing abrasion, and significantly reduces operational noise generation.

14 Claims, 2 Drawing Sheets

LIGHT WEIGHT, HIGH EFFICIENCY VIBRATOR APPARATUS FOR FACILITATING BULK MATERIAL HANDLING AND TRANSPORT

BACKGROUND OF THE INVENTION

The present invention relates generally to material handling apparatus and, in a preferred embodiment thereof, more particularly provides a light weight, high efficiency industrial vibrator for facilitating the handling and transport of bulk material in and through a wide variety of material handling structures.

The handling and transport of bulk material within and through material handling structures such as bins, hoppers, feeders, conveyors, and the like, are conventionally assisted by continuously vibrating such structures using devices generically referred to as industrial vibrators. Vibrators of this type typically include a hollow housing, formed from a high density metal material such as malleable cast iron, which is boltable or otherwise rigidly securable to the material handling structure, and a force generating element captively retained within the housing and cyclically driveable therein to impart vibrational forces to the material handling structure through the vibrator housing anchored thereto.

There are two primary types of industrial vibrators currently in use—linear and rotary. The linear type vibrator typically comprises a metal piston which is disposed within a heavy metal housing and reciprocated therein to impart the necessary vibrational forces to the material handling structure to which the metal housing is fixedly secured. Rotary vibrators are similarly constructed, and provided with a heavy metal housing fixedly securable to the material handling structure, but are provided with a metal force imparting structure which is rapidly rotated within the housing to transmit oscillating vibrational forces therethrough to the material handling structure.

Throughout the industrial vibrator industry, it has long been thought necessary to employ these heavy, all-metal vibrator housing structures to withstand the vibrational forces generated by the force imparting members captively retained and rapidly moved therein. However, conventional all-metal vibrator housing structures carry with them a variety of well known problems, limitations, and disadvantages.

For example, it is customary to press-fit within the housing structure interior a metal guide structure along which the metal force imparting member is moved during vibrator operation. The use of this press-fitted metal guide structure creates a high degree of operational noise and vibrational chatter when it is deflected and banged against the metal housing structure during vibrator operation. Additionally, the use of an all-metal housing structure in an industrial vibrator greatly increases the overall vibrator weight. Accordingly, large industrial vibrators of this conventional construction are typically awkward and quite difficult, particularly for one man, to lift into place and operatively secure to the particular material handling structure.

Additionally, the great weight of the typical industrial vibrator, due to its all-metal housing structure, significantly reduces its efficiency in transmitting the requisite vibrational forces from the internal force imparting member to the material handling structure. This is due to the fact that a very significant portion of the available vibrational forces is inefficiently absorbed in the metal housing and accordingly is not usefully transferred to the material handling structure. This large absorption o otherwise useful vibrational forces within the metal housing also significantly increases the overall energy which the housing must withstand. In turn, this accelerates the wear upon the housing and functions to ultimately reduce the useful life of the overall vibrator structure.

In view of the foregoing, it can readily be seen that a need exists for improving the structure and operational efficiency of industrial vibrators. It is accordingly an object of the present invention to provide improved industrial vibrator apparatus which eliminates o minimizes the above-mentioned and other problems, limitations, and disadvantages typically associated with industrial vibrators of conventional construction.

SUMMARY OF THE INVENTION

The present invention significantly departs from conventional design criteria for industrial vibrators and provides a light weight, high efficiency vibrator having a reinforced, injection molded plastic housing within which a metal force imparting member is captively retained and cyclically driven by an external power source to transmit the requisite oscillating vibrational forces to the material handling structure to which the light weight plastic housing is fixedly secured. To prevent the metal force imparting member from wearing away the interior surface of the plastic housing, and to provide a variety of other advantages, a metal guide structure, which movably supports the force imparting member and isolates it from the interior housing surface, is fixedly secured within the housing—preferably by molding the metal guide structure integrally with the plastic housing.

In a preferred embodiment of the present invention, this unique design concept is representatively incorporated in a rotary ball type vibrator. However, as will be readily appreciated by those skilled in this particular art, the principles of the present invention could also be advantageously utilized in conjunction with linear vibrators, and with rotary vibrators of other types. The rotary ball type industrial vibrator representing a preferred embodiment of this invention includes a generally T-shaped injection molded, light weight reinforced plastic housing having a pair of oppositely directed leg portions which project outwardly from a transverse body portion and are adapted to be bolted to a wall of a bulk material handling structure—for example, a sloping outlet section wall portion of a hopper.

The housing body portion has formed therein a generally circularly cross-sectioned chamber which opens at one of its ends outwardly through a side surface of the housing body. The outer chamber end is internally threaded and threadingly receives a cylindrical cover plug member having a series of fluid exhaust openings formed therethrough. A metal force imparting ball is captively retained within the housing chamber and is rapidly rotated therein by a pressurized fluid injected tangentially into the housing chamber through an appropriate inlet opening formed through the housing body. Pressurized air forced into the housing through such inlet opening is exhausted through the exhaust openings formed in the cover plug member.

During operative, air-driven rotation of the force imparting ball within the housing chamber, the ball rolls along a metal raceway structure disposed within the housing chamber. The metal raceway structure is defined by a first, generally annular metal raceway member molded integrally within the housing chamber adjacent its inner end, and a second, generally annular metal raceway member molded integrally with the housing cover plug member. The force imparting ball rolls along an inner side sur face of the integrally molded metal raceway structure which defines a contact surface for the rotating ball and functions to isolate the rotating ball from the interior side surface of the housing chamber, thereby essentially preventing such inner side surface of the housing from being worn away by the operatively rotated force imparting ball.

This unique construction of the industrial vibrator provides it with a variety of advantages over conventional vibrators having heavy, all-metal housing structures. For example, since the metal raceway structure is integrally molded with the light weight plastic housing, the usual metal-to-metal ringing or chattering noise present in conventional housings is essentially eliminated. Accordingly, the vibrator of the present invention is significantly quieter in operation than conventional industrial vibrators.

Additionally, the unique use of an all-plastic housing structure very substantially reduces the overall weight of the vibrator. This, in turn, permits it to be more easily lifted and installed than conventional vibrators. Additionally, and quite importantly, the light weight, all-plastic housing structure provides for significantly enhanced vibratory energy transmission from the rapidly moving force imparting member to the material handling structure through the vibrator housing due to the fact that substantially less vibrational energy is absorbed by the plastic housing. This, in turn, significantly reduces the operational stresses imposed on the housing and advantageously extends the operational life of the vibrator.

DETAILED DESCRIPTION

Figure 1:
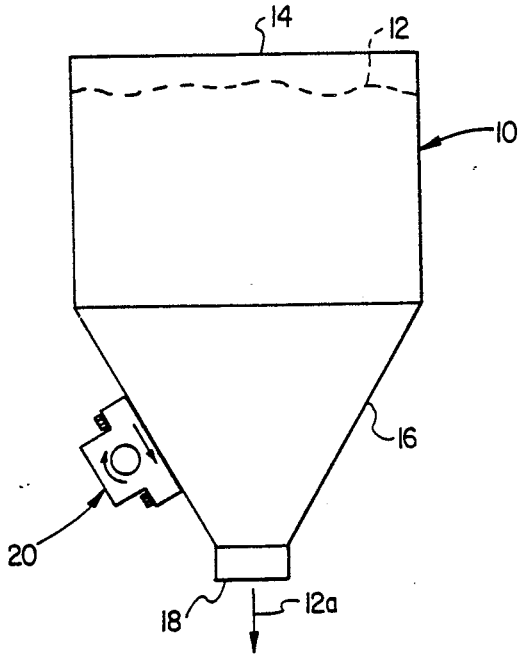
FIG. 1 is a side elevational view of the light weight, high efficiency vibrator device which embodies principles of the present invention and is representatively mounted on the sloping outlet portion of a material handling bin, the vibrator being operative to facilitate material flow through the bin.

Illustrated in FIG. 1 is a representative material handling structure in the form of a hopper 10 in which a bulk material 12 is disposed. The hopper 10 has an open top end 14, a conically shaped lower outlet section bounded by a downwardly and inwardly sloped wall portion 16, and a bottom outlet opening 18. To facilitate efficient and complete outflow 12*a* of the material 12 through the hopper outlet opening 18, and inhibit undesirable clogging, bridging and the like of the material 12 within the hopper, the present invention, in a preferred embodiment thereof, provides a uniquely constructed rotary ball type industrial vibrator 20 which is secured to the sloped hopper wall 16 and is operative in a manner subsequently described to impart to hopper 10 oscillating vibratory forces.

The hopper 10 is merely representative of a wide variety of material handling structures to which an industrial vibrator embodying principles of the present invention could be secured to impart vibrational forces thereto. Other types of material handling structures would include, but would not be limited to, chutes, vibratory feeders, vibratory conveyors, product segregation structures, material compaction structures, and vibratory stress reduction apparatus.

Additionally, while a rotary ball type industrial vibrator is illustrated, the principles of the present invention, discussed below, are also applicable to other types of industrial vibrators including linear vibrators and other types of rotary vibrators.

Figure 2:
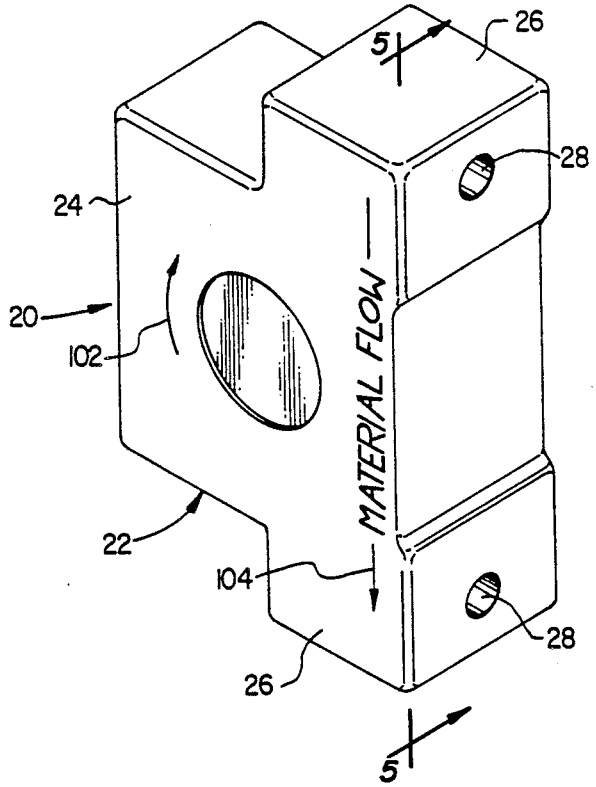
FIG. 2 is an enlarged scale right side perspective view of the vibrator device removed from the bin.
Figure 3:
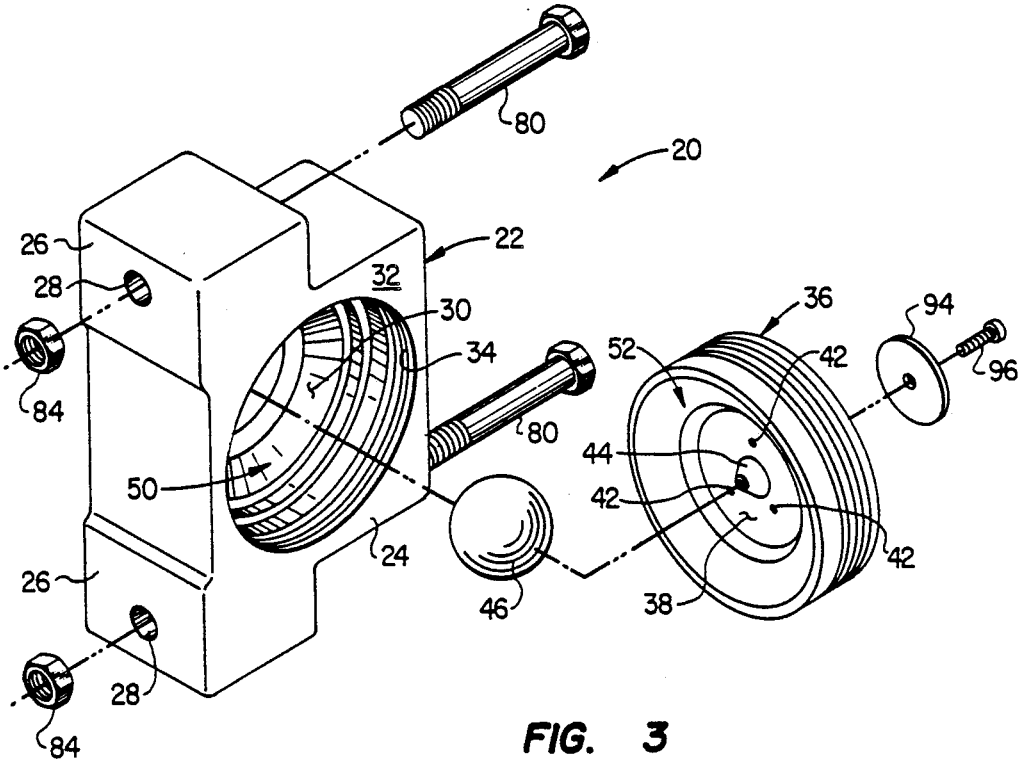
FIG. 3 is an enlarged scale exploded left side perspective view of the vibrator device.

Referring now to FIGS. 2 and 3, the rotary ball type vibrator 20 includes a generally T-shaped housing 22 having a rectangular body portion 24 from one end of which a pair of rectangularly cross-sectioned mounting legs 26 transversely project in opposite directions, each of the mounting legs having a circular mounting opening 28 formed therethrough.

Importantly, and directly contrary to conventional design theory in the industrial vibrator art, the housing 22 is not of a heavy weight, all-metal construction. Instead, and quite uniquely, it is injection molded from a light weight, reinforced plastic material. Set forth below is a representative listing of plastic materials which are suitable for use in forming the housing 22.

Acetals
Cellulosics
Nylons
Polyarylate
Polycarbonate
Polybutylene Terephthalate (PBT)
Polyethylene Terephthalate (PET)
Polyetherimide
Ionomer
Polyphenylene Ether
Polypropylene (Homopolymer & Copolymer)
Acrylonitrile (Butadiene & Styrene) (ABS)

The above-listed polymer base materials are acceptable with the use of glass fiber reinforcement, mineral additives or modifiers to give them the strength necessary to withstand the forces generated by the vibrator 20.

In addition, the lightweight plastic material of the housing 22 could be selected from the following list of materials.

Acrylonitrile-Butadiene-Styrene/Nylon (With or without glass fiber added)
Acrylonitrile-Butadiene-Styrene/Polycarbonate (With or without glass fiber added)
Acrylonitrile-Butadiene-Styrene/Polyvinyl Chlorine
Polycarbonate/Nylon (With or without glass fiber added)
Polycarbonate/Polyester (With or without glass fiber added)

It will be appreciated that the materials listed herein are merely representative, and a variety of other plastic materials could be used to form the vibrator housing 22.

Figure 5:
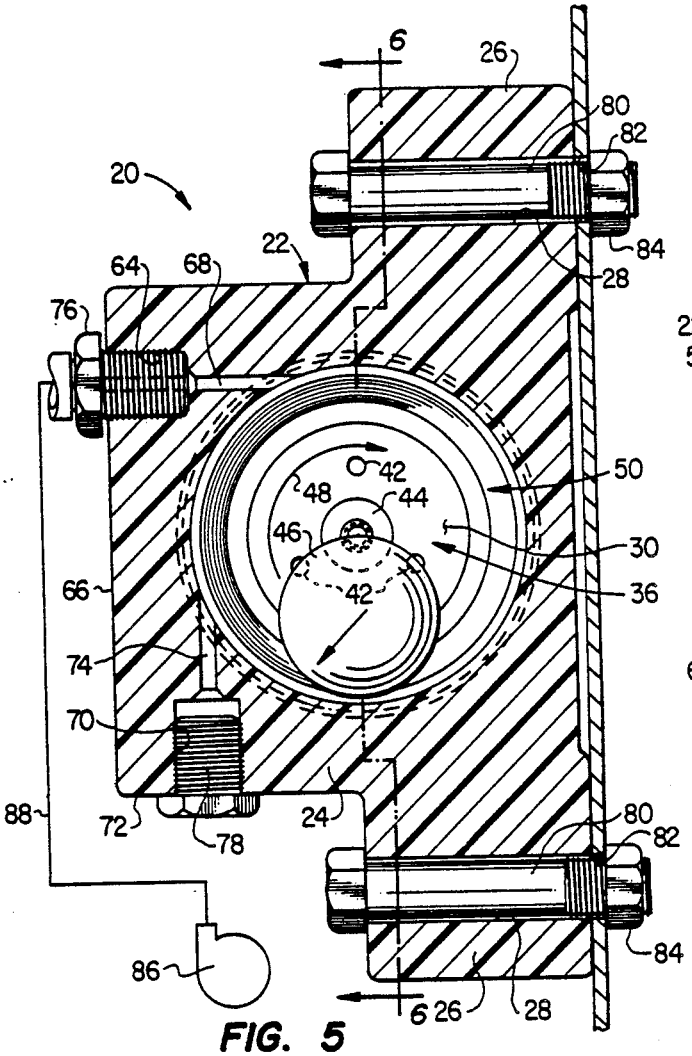
FIG. 5 is an enlarged scale cross-sectional view through the vibrator device, operatively mounted on the bin, taken along line 5—5 of FIG. 2.
Figure 6:
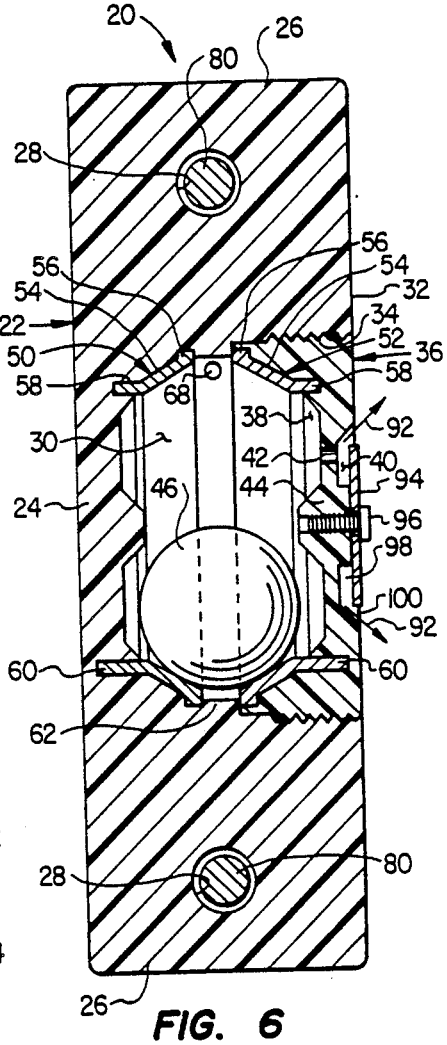
FIG. 6 is a cross-sectional view through the vibrator device taken along line 6—6 of FIG. 5.
Figure 7:
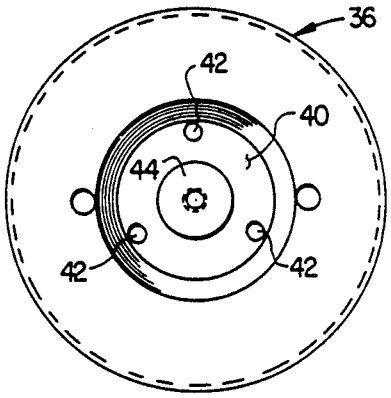
FIG. 7 is an outer side elevational view of a housing cover insert portion of the vibrator device.
Figure 4:
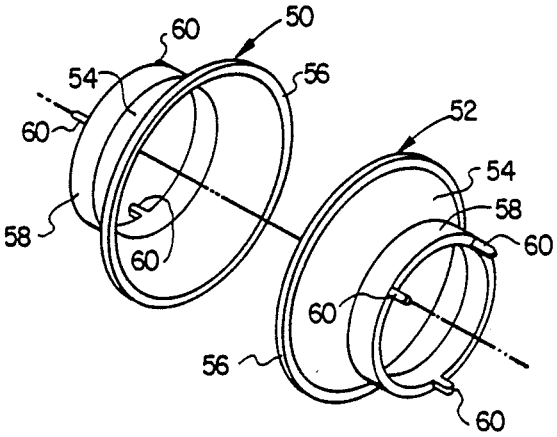
FIG. 4 is a perspective view of two metal raceway sections which are integrally molded into plastic housing portions of the vibrator device.

Turning now to FIGS. 3, 5 and 6, a circularly cross-sectioned chamber 30 is molded into the housing body portion 24 and opens, at one of its ends, outwardly through the housing side surface 32. An outer end portion of the chamber 30 is internally threaded, as at 34, and is adapted to threadingly receive an externally threaded cover plug member 36 (see also FIG. 7) which functions to close the open outer end of the chamber 30. The inner side of the cover plug member 36 is recessed, as at 38 (FIG. 3), while the outer side of the cover plug member is provided with a smaller diameter recess 40 (FIG. 7). For purposes later described, three small, circumferentially spaced exhaust openings 42 are formed through the cover plug member 36 around a hollow boss member 44 positioned centrally thereon.

A vibratory force imparting member, in the form of a steel ball 46, is captively retained within the housing chamber 30 when the cover plug member 36 is operatively threaded thereinto. In a manner subsequently described, the ball 46 (FIG. 5) is rotationally driven at high velocity around the interior periphery of the housing chamber 30 as indicated by the arrow 48 in FIG. 5.

According to an important aspect of the present invention, the interior plastic peripheral surface of the housing chamber 30 is protected against being worn away by the rapidly rotating metal ball 46 by means of a pair of generally annular metal raceway section 50 and 52 which are molded integrally within the housing body portion 24 and the cover plug member 36, respectively. Each of these metal raceway sections has a generally conically tapered body portion 54, a radially outwardly projecting annular flange 56 at its larger diameter end, an axially extending annular flange 58 at its smaller diameter end, and three circumferentially spaced, axially outwardly projecting retention tabs 60 at the outer end of the axial flange 58.

As best illustrated in FIG. 6, the raceway section 52 is molded into the housing body portion 24 and is coaxially disposed within the housing chamber 30 at its closed inner end. As indicated, the flange 56, the flange 58, and the retention tabs 60 of the raceway section 50 are imbedded in the plastic housing material and respectively lock the raceway section 50 against axial, radial and rotational movement relative to the housing.

The raceway section 52 is closely and coaxially received within the inner side recess 38 of the cover plug member 36, with the flange 56 being axially inset into the cover plug member, and abutting an annular ledge 62 formed within the housing opening 30, while the flange and retention tab portion 58 and 60 are imbedded within the cover plug member 36. With the cover plug member 36 threaded into the housing chamber 30 (FIG. 6) it can be seen that the raceway sections 50 and 52 are axially aligned and spaced apart, and collectively define a metal raceway path or contact surface along which the ball 46 is rotatable. Importantly, this metal raceway path completely isolates the rotating ball 46 from the interior plastic side surface of the housing chamber 30.

Referring now to FIG. 5, an internally threaded circular bore 64 extends rightwardly into the left side surface 66 of the housing body portion 24, and communicates at its inner end with a smaller diameter air inlet passage 68 which extends generally tangentially into the housing chamber 30. In a similar fashion, an internally threaded circular bore 70 extends upwardly through the bottom side surface 72 of the housing body portion 24, and communicates at its upper end with a vertically extending air inlet passage 74 which generally tangentially communicates with the housing chamber 30. A cylindrical air inlet nozzle 76 is threaded into the bore 64, and a plug member 78 is threaded into the bore 70.

To use the vibrator 20, the mounting leg portions 26 of the housing body are positioned against the sloped hopper wall 16, and mounting bolts 80 are passed inwardly through the leg openings 28, and mounting openings 82 formed in the hopper wall 16, and threaded into nuts 84. A pressurized air source, such as an air pump 86, is communicated with the air inlet fitting 76, via a conduit 88, to flow high velocity tangentially directed pressurized air into the housing chamber 30 through the air inlet passage 68.

The pressurized, high velocity air tangentially entering the housing opening 30 rotationally drives the metal ball 46, as indicated by the arrow 48, in a clockwise direction along the raceway contact surface defined by the interior side surfaces of the raceway sections 50 and 52. The rotating ball 46 imparts to the housing 22, and thus to the hopper wall 16, a resultant force 90 having both centrifugal and tangential components. This resultant force 90, like the ball 46, continuously rotates in a clockwise direction as viewed in FIG. 5. Accordingly, a rotationally oscillating vibratory force is transmitted to the housing wall 16 via the plastic housing 22. For convenience, as best illustrated in FIG. 2, an arcuate directional arrow 102 is molded onto the side of the vibrator housing 22 to indicate the direction of driven ball rotation. Additionally, a directional . arrow 104, together with the words "material flow" is molded onto the housing to assist the installer in properly orienting the vibrator on the hopper 10.

To inhibit loosening of the housing cover plug member 36 during high speed, air-driven rotation of the ball 46 the threads on the cover plug member 36 and the chamber opening 30 are formed in a manner such that the cover plug member is rotationally tightenable in the same direction as that of the ball rotation.

Pressurized air forced into the housing chamber 30 to rotationally drive the metal ball 46 is discharged from the interior of the housing through the three exhaust openings 42 in the cover plug member 36 (see FIGS. 6 and 7) in the form of exhaust air 92. To diffuse the outflow of exhaust air, a baffle washer 94 is secured to the outer end of the cover plug member boss 44 by a screw 96. The baffle washer 94 defines within the cover plug member outer side recess 40 an annular chamber 98 having an annular outlet opening 100 defined between the peripheries of the outer side recess 40 and the baffle washer 94. Accordingly, the exhaust air 92 exiting the cover plug member openings 42 enters the chamber 98, is radially outwardly redirected, and is then discharged through the annular outlet opening 100 as best illustrated in FIG. 6.

Referring again to FIG. 5, it should be noted that, if desired, the air inlet fitting 76 may be positioned in the threaded bore 70, and the plug 78 positioned within the threaded bore 64, so that the ball-propelling pressurized air upwardly enters the housing opening 30. This alternate air inlet positioning of the present invention provides installation flexibility for the vibrator 20 where space requirements preclude air supply conduit connection to one or the other of the two indicated air inlet locations. Additionally, if desired, the illustrated plug member 78 could be replaced with a second air inlet nozzle, and the conduit 88 additionally routed to this second air inlet nozzle, to force dual pressurized air streams into the housing opening 30.

The vibrator 20 of the present invention provides a variety of structural and operational advantages over industrial vibrators of conventional all-metal housing construction. For example, the use of the all-plastic housing significantly reduces the weight of the vibrator, making it much easier to lift, handle and install. The greatly reduced housing weight also more efficiently transfers vibrational forces from the force imparting member through the housing to the material handling structure since far less vibrational energy is absorbed within the light weight plastic housing. This lessening of vibrational energy absorption also reduces operational stresses imposed on the vibrator housing, thereby increasing the useful life of the vibrator.

With regard to weight, it is customary practice in the industrial vibrator industry to furnish (or make available) force imparting members of varying weights, a selected one of which may . be removably and interchangeably positioned within a particular vibrator housing to selectively vary the magnitude of the vibrational forces generated by a given vibrator during operation thereof. For example, the illustrated rotary ball type vibrator 20 may be provided with a series of metal balls of differing weights, ranging from a lightest ball to a heaviest ball, any one of which may be quickly placed in the housing chamber 30 (after removing the ball previously disposed therein) to selectively increase or decrease the vibrational force output of the vibrator 20 using the same air driving force.

In conventional vibrators, when the heaviest force imparting member of such series thereof is used, the ratio of the housing weight to the driven force imparting member weight is typically quite high—usually at least 12-1 and often considerably higher. In the vibrator 20, however, this weight ratio (when the heaviest ball of the series is used) is substantially lessened, to around 4-1, by the unique use of the described plastic housing construction.

The use of plastic as the housing material also greatly reduces vibrator operating noise since there is no metal-to-metal chattering and banging between the raceway structure and the housing. The plastic housing does not have to be coated to render it suitable for use in pharmaceutical and food handling applications, and the housing may be more accurately and inexpensively fabricated compared to metal vibrator housings.

Further, the illustrated vibrator 20 has only three parts—the housing proper, the metal ball, and the cover plug member. This simplified construction allows the vibrator to be more quickly assembled and disassembled, and provides for more rapid ball changeout. Finally, the use of the plastic housing, with its molded-in raceway structure, provides for greatly enhanced installation flexibility since the illustrated air inlet openings may be easily and inexpensively repositioned during the fabrication of the housing.

The foregoing description is to be clearly understood as being given by way of illustration and example only, the spirit, and scope of the present invention being limited solely by the appended claims.

What is claimed is:

1. Apparatus for imparting vibrational forces to a material handling structure, comprising:

a housing structure formed essentially entirely from a relatively light weight nonmetallic material, said housing structure being rigidly securable to said material handling structure and having a chamber therein;

a metal force imparting member captively retained within said chamber and operatively movable therein in a manner imparting vibrational forces to said housing structure;

means, carried by said housing structure, for utilizing an external power source to operatively move said force imparting member within said chamber; and a wear prevention structure fixedly and essentially permanently secured to said housing structure and formed from a material harder than that of said housing structure, said wear, prevention structure defining within said chamber a contact surface along which said force imparting member travels during operative movement, thereof, said contact surface being positioned to isolate said force imparting member from the surface of said chamber during said operative movement of said force imparting member.

2. The apparatus of claim 1 wherein:

said wear prevention structure is formed from a metal material and said housing structure is formed from a reinforced plastic material.

3. The apparatus of claim 2 wherein:

said housing structure is injection molded from said reinforced plastic material, and said wear prevention structure is integrally molded with said housing structure.

4. Apparatus for imparting vibrational forces to a material handling structure, comprising:

a housing structure formed essentially entirely from a relatively light weight nonmetallic material, said housing structure being rigidly securable to the material handling structure and having an internal chamber, a metal force imparting member captively and removably retained within said chamber and being operatively movable therein to impart to said housing structure vibrational forces which are transmitted therethrough to the material handling structure, said metal force imparting member being the heaviest of a plurality of metal force imparting members of varying weights which may be interchangeably positioned within said chamber to selectively vary the magnitude of said vibrational forces, the ratio of the weight of said housing structure to the weight of said force imparting member being substantially less than approximately twelve-to-one to facilitate efficient transmission of said vibrational forces through said housing structure to the material handling structure;

means, carried by said housing structure, for utilizing an external power source to operatively move said force imparting member within said chamber; and a metal wear prevention structure essentially permanently secured to said housing structure and defining within said chamber a contact surface along which said force imparting member travels during operative movement thereof, said contact surface being positioned to isolate said force imparting member from the surface of said chamber during operative movement of said force imparting member.

5. The apparatus of claim 4 wherein:

said housing structure is injection molded from a reinforced plastic material, and said metal wear prevention structure is molded integrally with said housing structure.

6. The apparatus of claim 4 wherein:

said ratio of the weight of said housing structure to the weight of said force imparting member is not substantially greater than approximately four-to-one.

7. The apparatus of claim 6 wherein:

said housing structure is injection molded from a reinforced plastic material, and said metal wear prevention structure is molded integrally with said housing structure.

8. A rotary ball type industrial vibrator comprising:

a housing formed essentially entirely from a reinforced plastic material and including:

a body portion rigidly securable to an object to be vibrated, a generally circularly cross-sectioned chamber formed in said body portion and opening, at one end thereof, outwardly through an exterior surface of said body portion, a fluid inlet opening formed in said body portion for flowing a pressurized driving fluid, from a source thereof, generally tangentially into said chamber, a cover member removably securable to said body portion over said end of said chamber, and an exhaust opening extending through said cover member for venting pressurized fluid from said chamber;

a first, generally annular metal raceway member fixedly secured to said body portion coaxially within said chamber adjacent its inner end;

a second, generally annular metal raceway member fixedly secured to said cover member, said first and second raceway members collectively defining within said chamber, when said cover member is operatively secured to said body portion, a generally annular metal raceway surface radially inset from the interior side surface of said chamber; and a metal ball positioned within said chamber to be rapidly rolled around and along said raceway surface in response to a flow of pressurized fluid into said chamber through said fluid inlet opening.

9. The industrial vibrator of claim 8 wherein:

said body portion and said cover member are injection moldings, said first metal raceway member is integrally molded with said body portion, and said second metal raceway member is integrally molded with said cover member.

10. The industrial vibrator of claim 8 wherein:

said cover member is threadable into said end of said chamber.

11. The industrial vibrator of claim 10 wherein:

said cover member is rotationally tightenable into said end of said chamber in the same direction as the operative rotational direction within said chamber of said metal ball.

12. The industrial vibrator of claim 8 further comprising:

a baffle member externally secured to said cover member, and overlying said exhaust opening, for intercepting and diffusing pressurized fluid discharged from said chamber through said exhaust opening.

13. The industrial vibrator of claim 8 further comprising:

an additional fluid inlet opening formed in said body portion for flowing a pressurized fluid, from a source thereof, generally tangentially into said chamber at a point circumferentially offset from the outlet end of said first-mentioned fluid inlet opening.

14. A rotary ball type industrial vibrator comprising:

a hollow, injection molded reinforced plastic housing;

a generally annular metal raceway structure integrally molded with and nonmovably locked to said housing within its interior;

a metal ball disposed within said housing for fluid driven rotational movement around and along the interior side surface of said metal raceway structure; and an inlet opening formed in said housing for receiving pressurized fluid from a source thereof and flowing the received fluid into said chamber to rotationally propel said metal ball around said metal raceway structure.

* * * * *